US007575505B2

(12) United States Patent
Lamers

(10) Patent No.: US 7,575,505 B2
(45) Date of Patent: Aug. 18, 2009

(54) HAND TOOL QUICK RELEASE MECHANISM

(76) Inventor: John Lamers, 333961 Plank Line, Ingersoll, ON (CA) N5C 3J8

( * ) Notice: Subject to any disclaimer, the term of this patent is extended or adjusted under 35 U.S.C. 154(b) by 0 days.

(21) Appl. No.: 11/902,765

(22) Filed: Sep. 26, 2007

(65) Prior Publication Data

US 2008/0020689 A1 Jan. 24, 2008

(51) Int. Cl.
*B24D 15/00* (2006.01)

(52) U.S. Cl. ..... 451/344; 451/354; 451/523; 451/525

(58) Field of Classification Search ..... 451/340, 451/344, 354, 523, 524, 525
See application file for complete search history.

(56) References Cited

U.S. PATENT DOCUMENTS 4,478,011 A * 10/1984 Russell ..... 451/492
4,937,984 A * 7/1990 Taranto ..... 451/524
6,296,558 B1 * 10/2001 Poole et al. ..... 451/557
7,033,259 B1 * 4/2006 Seasholtz et al. ..... 451/354
7,416,477 B2 * 8/2008 Henke et al. ..... 451/344

* cited by examiner

*Primary Examiner*—Eileen P. Morgan

(57) ABSTRACT

A hand tool quick release mechanism for releasably connecting a frame to a base, the quick release mechanism comprising a frame connecting mechanism and a base connecting mechanism each for respectively coupling releasably the frame and base together, wherein the frame and base are placed into an attached position by urging the frame connecting mechanism into the base connecting mechanism. The quick release mechanism claimed in claim 1 wherein the frame attachment mechanism including a push pad wherein applying finger pressure to the push pad operably disconnects the base from the frame such that the base and frame are in a detached position. The quick release mechanism claimed in claim 2 wherein the frame connecting mechanism including a catch, and the base connecting mechanism including a catch flange such that the catch and catch flange cooperatively and releasably couple together when the base and frame in an attached position.

12 Claims, 11 Drawing Sheets

FIG. 9
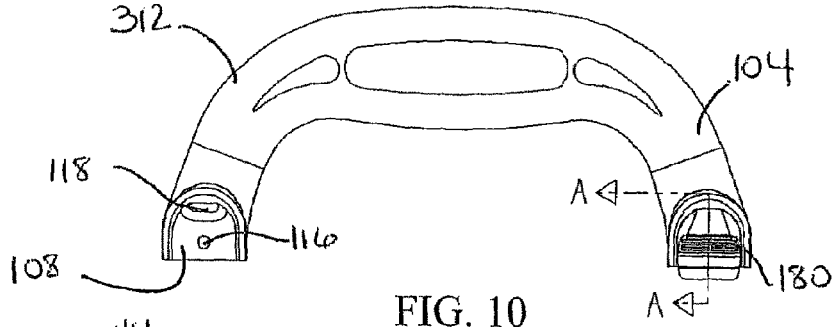
FIG. 12
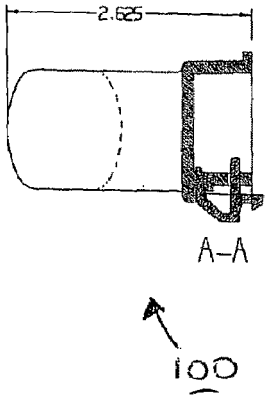
FIG. 10
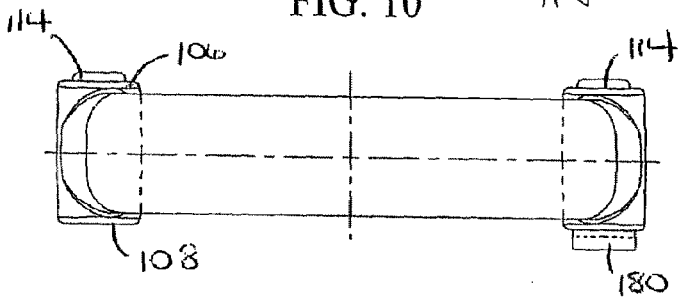
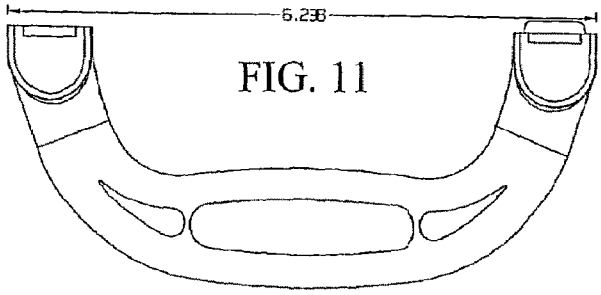
FIG. 11

C-C
191
902

100
A
B
C

A
B
B-B

902
A-A
88.0°

HAND TOOL QUICK RELEASE MECHANISM

CROSS REFERENCE TO RELATED APPLICATIONS

The application claims priority from previously filed U.S. provisional patent application No. 60/668,164, titled "Quick Release Mechanism" on Apr. 5, 2005 by John Lamers.

FIELD OF THE INVENTION

The present invention relates to quick release mechanism and particularly relates to a quick release mechanism particularly useful for hand tools and specifically useful for the attachment of handles and/or pole attachments to a sanding pad.

BACKGROUND OF THE INVENTION

Hand sanders and pole sanders have long been used in the sanding industry for various applications. Pole sanders in particular normally employ some type of a universal joint in order to permit the flat sand paper surface which is generally secured to a flat back surface of the sander to lie parallel to the wall or ceiling or floor surface against which the sand paper is applied during the sanding operation. The art in regard to pole sanders and the universal joints which are used is well established and generally when a pole sander is used, one is a considerable distance away from the surface, normally holding the pole sander from the end of a pole or broom handle through which pressure is applied to the sand paper surface.

Hand sanders as well come in many different shapes and sizes and forms and in particular there are applications in which hand sanders are more useful and required in order to complete the work, rather than the use of a pole sander. Often one must use a hand sander and a pole sander to complete a particular job. Therefore, it is desirable to have a combination hand sander and pole sander having a quick release mechanism which enables a user to be able to switch between a pole sander and a hand sander in a short period of time.

SUMMARY OF THE INVENTION

The present invention is a hand tool quick release mechanism for releaseably connecting a frame to a base, the quick release mechanism comprising; a frame connecting means and a base connecting means each for respectively coupling releasably the frame and base together, wherein the frame and base are placed into an attached position by urging the frame connecting means into the base connecting means.

Preferably wherein the frame attachment means including a push pad wherein applying finger pressure to the push pad operably disconnects the base from the frame such that the base and frame are in a detached position.

Preferably wherein the frame connecting means including a catch, and the base connecting means including a catch flange such that the catch and catch flange cooperatively and releasably couple together when the base and frame in an attached position.

Preferably wherein the frame connecting means including a lip and the base connecting means including a slot flange adapted to receive the lip slideably therein, such that the in the lip and slot flange cooperatively and releasably couple together when the base and frame in the attached position.

Preferably wherein the lip is operably spaced from the catch and the slot flange is operably spaced from the catch flange such that to place the frame and base into the attached position the lip is slideably urged into a slot defined in the base and then the catch is urged past the catch flange into a catch aperture defined in the base thereby coupling the catch with the catch flange.

Preferably wherein the frame connecting means including a latch wherein the catch integrally part of the latch, wherein the latch adapted to resiliently bias the catch against the catch flange when the catch being urged past the catch flange and into the catch aperture.

Preferably wherein the latch including a hinge member connected to one end of the push pad, wherein the hinge member adapted to resiliently bias the catch against the catch flange when the catch being urged past the catch flange.

Preferably wherein the latch including a guide member connected to the other end of the push pad for guiding the catch movement in a lateral direction when the catch is moved past the catch flange.

Preferably wherein the guide member and hinge member being substantially parallel and spaced apart by the push pad and extending horizontally away from the push pad.

Preferably wherein the hinge member attached at one to the push pad and including on the other end a locking tab, wherein the hinge member being received within a cooperatively dimensioned hinge slot defined in the frame, wherein the hinge member being firmly locked and held in the frame when the locking tab engaging with a portion of the frame.

Preferably wherein the hinge member resiliently bending about a hinge axis and thereby resiliently biasing the catch against the catch flange.

Preferably wherein the catch including an inclined surface for slidably contacting the catch flange when the catch being urged past the catch flange.

Preferably wherein the frame further including a guide aperture for slideably receiving the guide member therein thereby guiding the catch movement in a lateral direction when the catch is moved past the catch flange.

A hand tool with two spaced apart quick release mechanisms wherein the frames of each quick release mechanism attached to a connecting portion, the frame together with the connecting portion defining a universal attachment body, and wherein the bases of each quick release mechanism attached to a platform, wherein the bases together with the platform defining a universal platform, wherein the universal attachment body and the universal platform moveable between an attached position and detached position.

A hand sander with a detachable quick release handle; the hand sander including two spaced apart quick release mechanisms wherein the frames of each quick release mechanism attached to a connecting portion, the frames together with the connecting portion defining a unitary handle, and wherein the bases of each quick release mechanism attached to a platform, wherein the bases together with the platform defining a unitary sanding pad, wherein the handle and the sanding pad moveable between an attached position and detached position, wherein in the attached position the handle together with the sanding pad being a hand sander.

A pole sanding frame with a detachable quick release pole sanding body, the pole sanding frame comprising two spaced apart quick release mechanisms wherein the frames of each quick release mechanism attached to a connecting portion wherein the frames together with the connecting portion defining a unitary pole sanding body, and wherein the bases of each quick release mechanism attached to a platform wherein the bases together with the platform defining a unitary sanding pad, wherein the pole sanding body and the sanding pad moveable between an attached position and detached position, wherein in the attached position the pole sanding body together with the sanding pad being a pole sanding frame.

BRIEF DESCRIPTION OF THE DRAWINGS

The quick release mechanism will now be described by way of example only with reference to the following figures in which:

FIG. 9 is a side elevational view of the quick release mechanism deployed in the handle shown in FIG. 8.

FIG. 10 is a top plan view of the quick release mechanism deployed in the handle.

FIG. 11 is a side elevational view of the quick release mechanism deployed in the handle.

FIG. 12 is cross sectional view taken along lines A-A of FIG. 9 showing the quick release mechanism in cross section.

DETAILED DESCRIPTION OF THE PREFERRED EMBODIMENT

Figure 1:
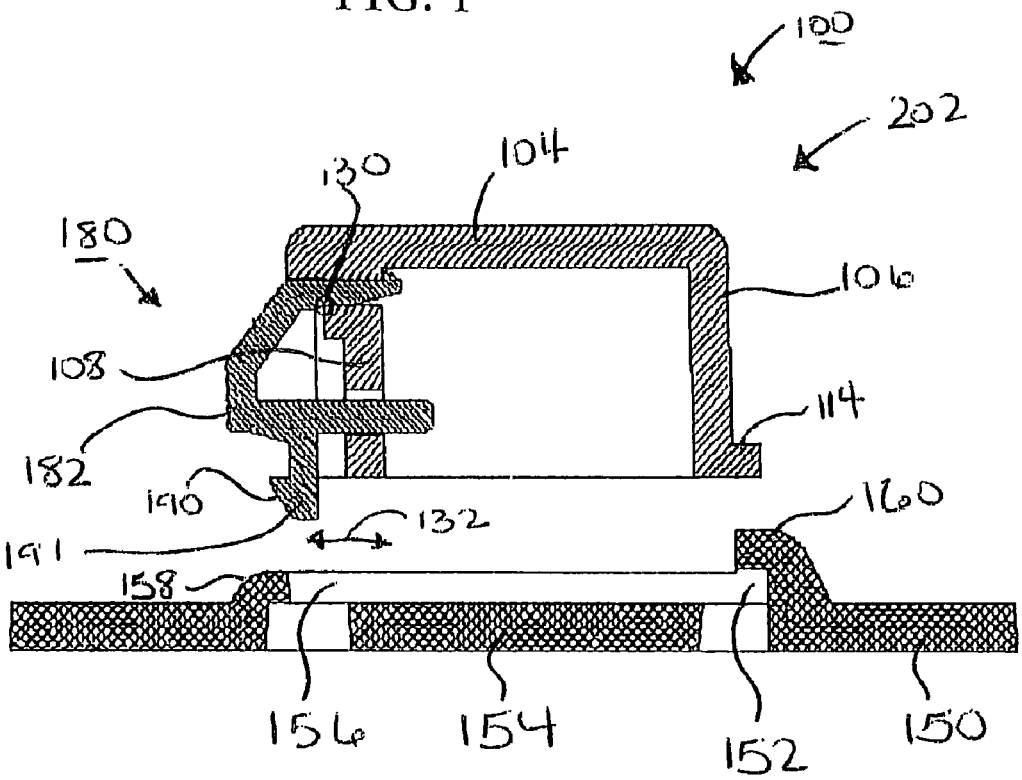
FIG. 1 is a cross sectional schematic view of the quick release mechanism in the detached position.
Figure 2:
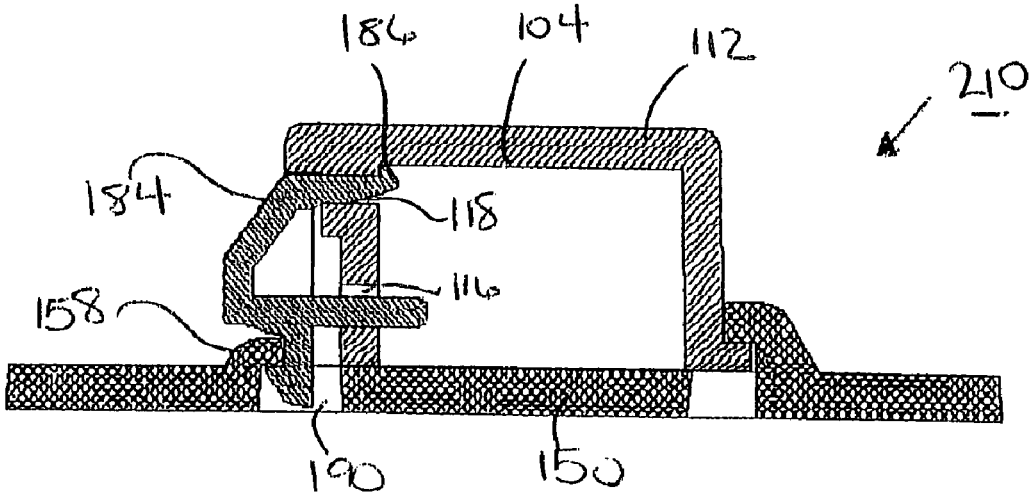
FIG. 2 is a schematic cross sectional view of the quick release mechanism in the attached position.

The present invention a quick release mechanism is shown generally as 100 in the Figures. FIGS. 1 and 2 in particular show in schematic fashion the quick release mechanism 100 in the detached position 202 shown in FIG. 1, and in the attached position 210 shown in FIG. 2. FIG. 3 through 7 shows the sequence for placing the quick release mechanism 100 from the detached position 202 to the attached position 210 in the sequence as shown in FIGS. 3 through 7 inclusively.

Quick release mechanism 100 includes the following major components namely frame 104, base 150 and a latch 180.

Frame 104 normally includes first member 106, second member 108, lip 114, guide aperture 116 and hinge slot 118.

Base 150 includes a slot 152, planar surface 154, catch aperture 156, and catch flange 158.

Latch 180 includes a push pad 182 connected to a hinge member 184, a guide member 188, and also a catch 190. Frame 104 may include a frame top portion 112 as shown schematically in FIG. 1. Note hinge member 184 sand guide member 188 are spaced from each other and preferably oriented parallel to each other. Hinge member 184 connected at one end of push pad 182 and guide member 188 connected to the other end of push pad 182 form in cross sectional view a roughly U shaped configuration.

Frame 104 and frame top portion 112 are normally integrally part of a connecting portion 303, wherein the connecting portion 303 together with one or more frames 104 in general terms forms a universal attachment body 906. The drawings show two examples of universal attachment body namely handle 302, and pole sanding body 402. These are only two examples of hand tools showing application of the quick release mechanism 100. Quick release mechanism 100 could also be applied to a number of other hand tools which would benefit from having a quick release portion of the tool.

Figure 8:
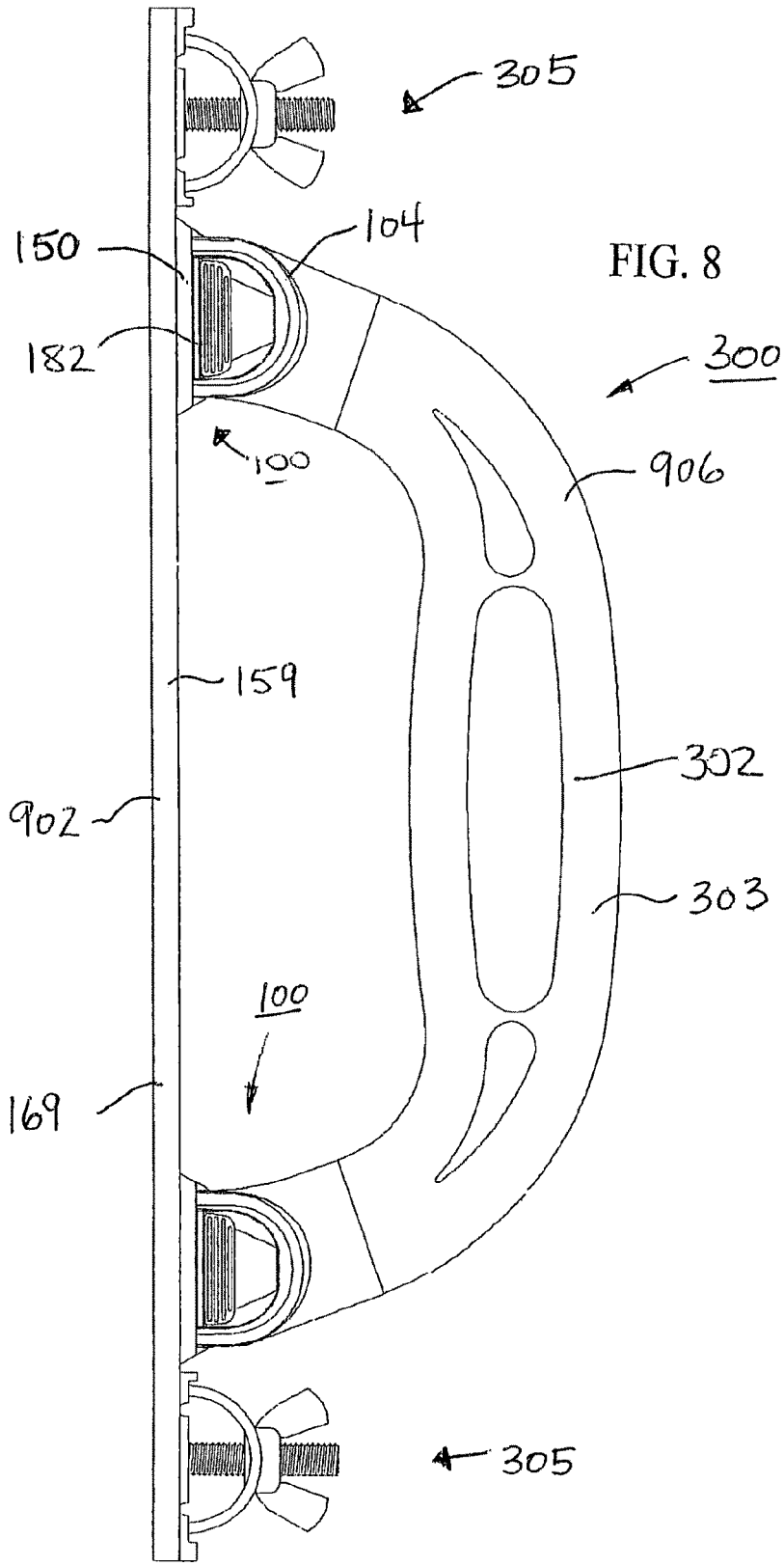
FIG. 8 is a schematic side elevational view of the quick release mechanism deployed in a hand sander together with a handle, and a base.

Frame 104 together with connecting portion 303 may form handle 302 as shown in FIG. 8, wherein two quick release mechanisms are shown deployed in hand sander 300 having two bases 150 connected with a universal platform 902 which in this case is simply platform 159, wherein platform together with bases 150 form a sanding pad 169. Optionally sanding pad 169 includes sand paper clamps 305. A person skilled in the art will recognize this as a hand sander 300, wherein sand paper is spanned across the bottom of sanding pad 169 and clamped by clamps 305 in position. Universal attachment body 906 which in this example is handle 302 can be easily and quickly attached or detached to universal platform 902 which in this example is sanding pad 169 using quick release mechanism 100.

Figure 13:
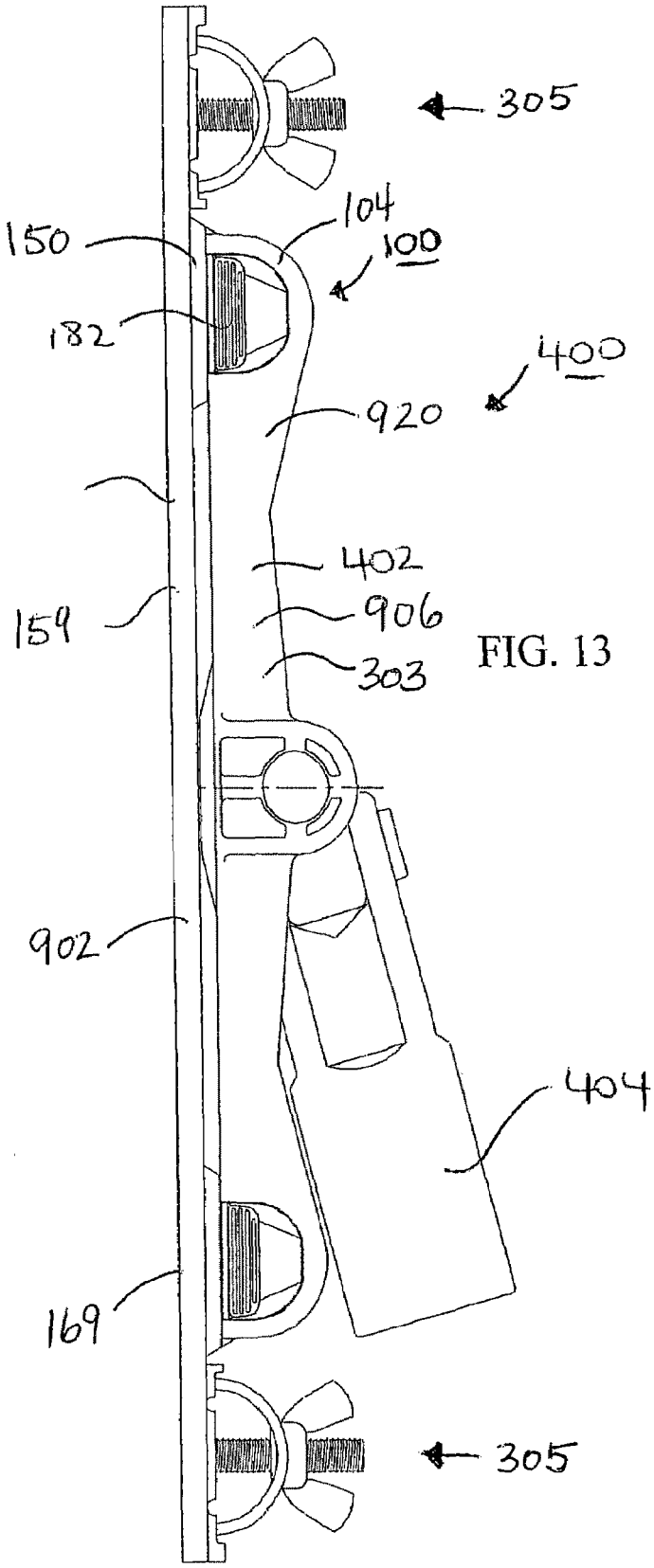
FIG. 13 is a side elevational view of the quick release mechanism deployed in a pole sander having a base and a frame.
Figure 14:
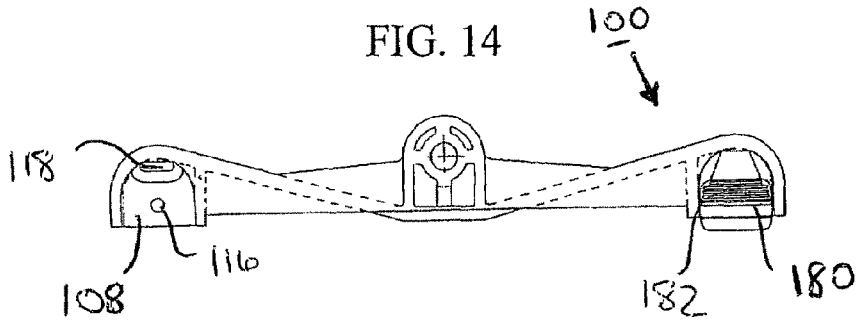
FIG. 14 is a side elevational view of a quick release mechanism deployed in the frame of a pole sander as shown in FIG. 13.
Figure 17:
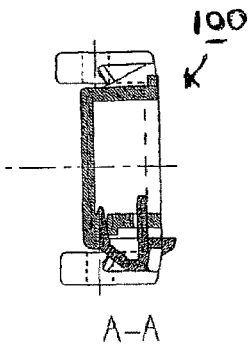
FIG. 17 is a cross sectional view taken along lines A-A of FIG. 15 showing the cross sectional details of the quick release mechanism 100.
Figure 15:
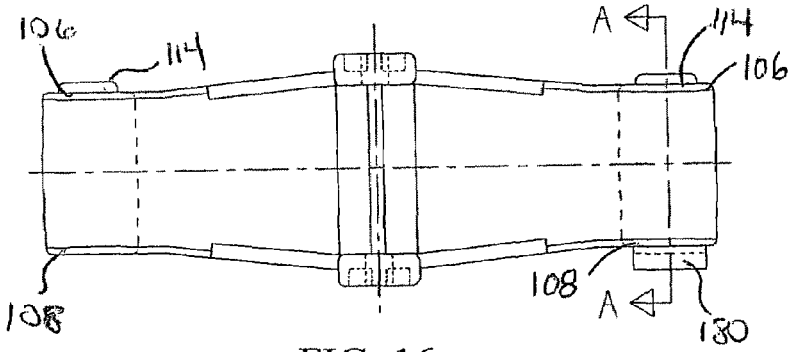
FIG. 15 is a top plan view of a quick release mechanism deployed in the frame of a pole sander as shown in FIG. 13.
Figure 16:
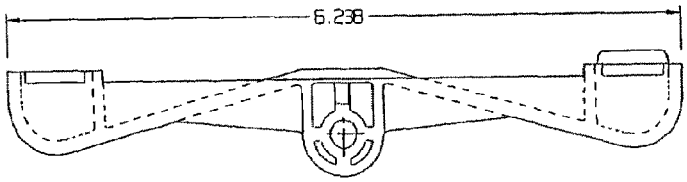
FIG. 16 is a side elevational view of the quick release mechanism deployed in the frame of a pole sander as shown in FIG. 13.
Figure 18:
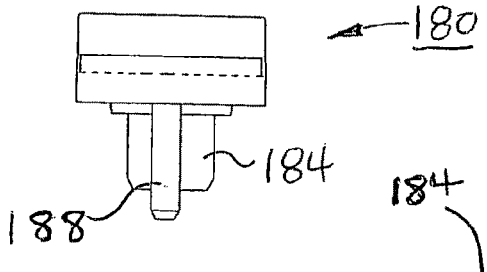
FIG. 18 is a top plan view of the latch portion of the quick release mechanism.
Figure 19:
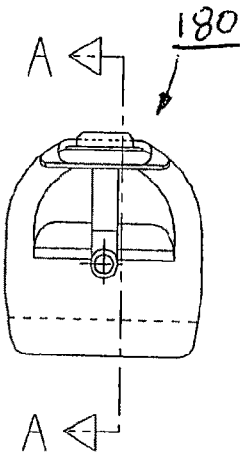
FIG. 19 is a rear elevational view of the latch mechanism shown in FIG. 18.
Figure 20:
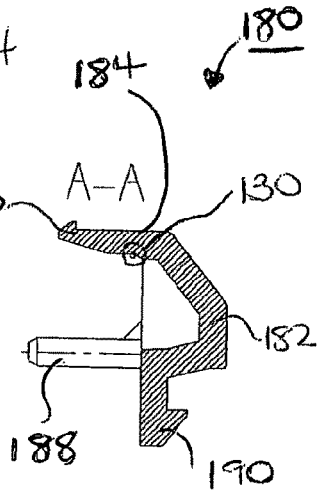
FIG. 20 is a cross sectional view taken along lines A-A of FIG. 19 of the latch portion of the quick release mechanism.
Figure 21:
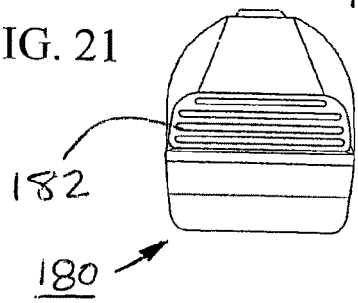
FIG. 21 is a front elevational view of the latch portion of the quick release mechanism.
Figure 22:
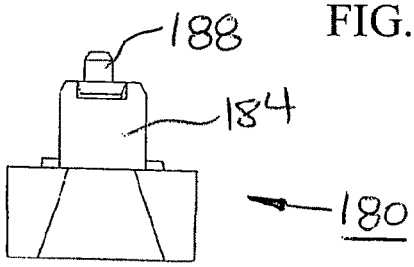
FIG. 22 is a bottom plan view of the latch portion of the quick release mechanism shown in FIG. 21.
Figure 27:
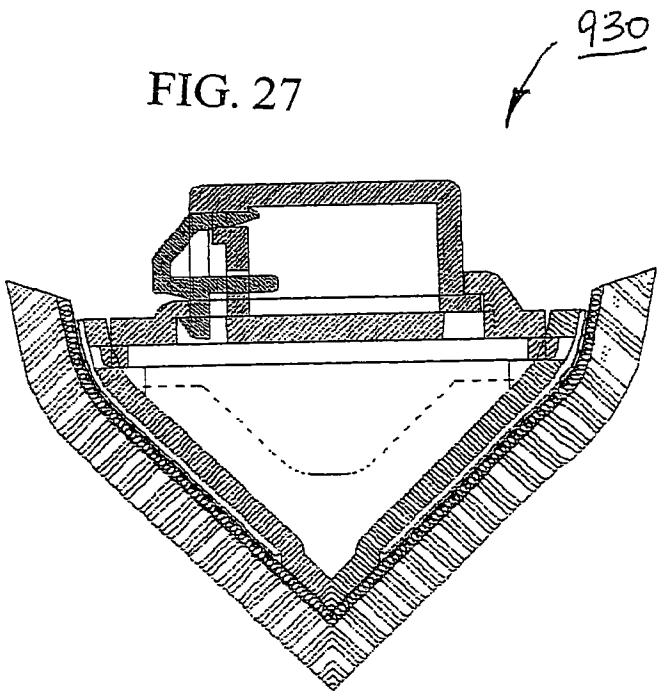
FIG. 27 is a schematic cross sectional assembly view of a corner sander showing the universal attachment body connected to the universal platform shown in the attached position.
Figure 23:
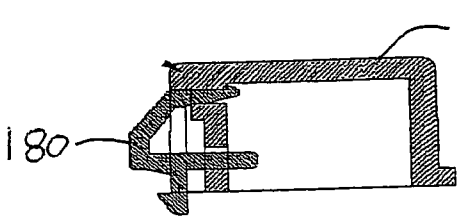
FIG. 23 is a schematic cross sectional view of the universal attachment body portion of the quick release mechanism.
Figure 24:
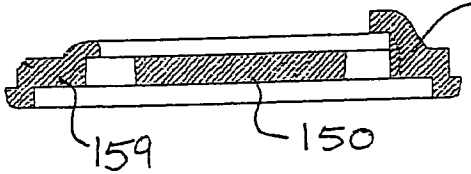
FIG. 24 is a schematic cross sectional view of a universal platform portion of the quick release mechanism.
Figure 25:
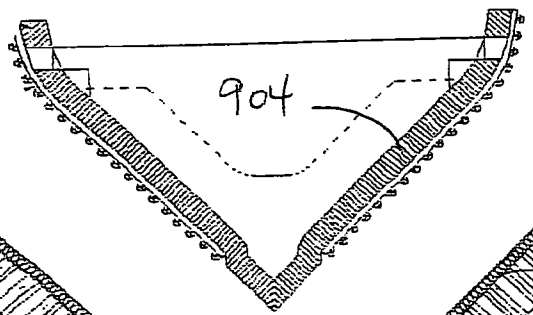
FIG. 25 is a schematic cross sectional view of the corner sanding base.
Figure 26:
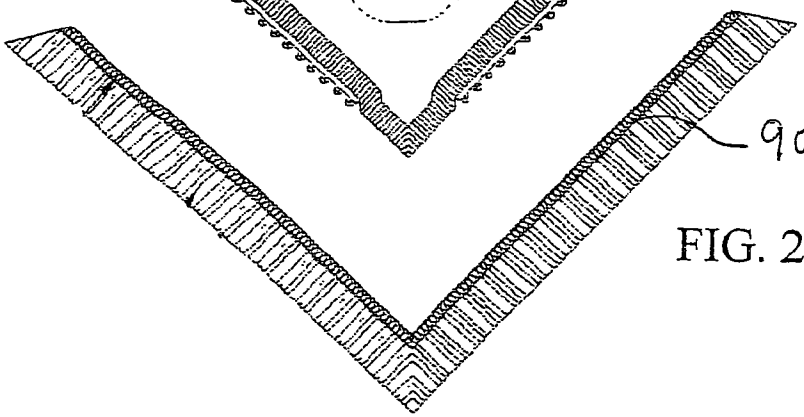
FIG. 26 is a schematic cross sectional view of sand paper.
Figures 28, 29, 30, 31:
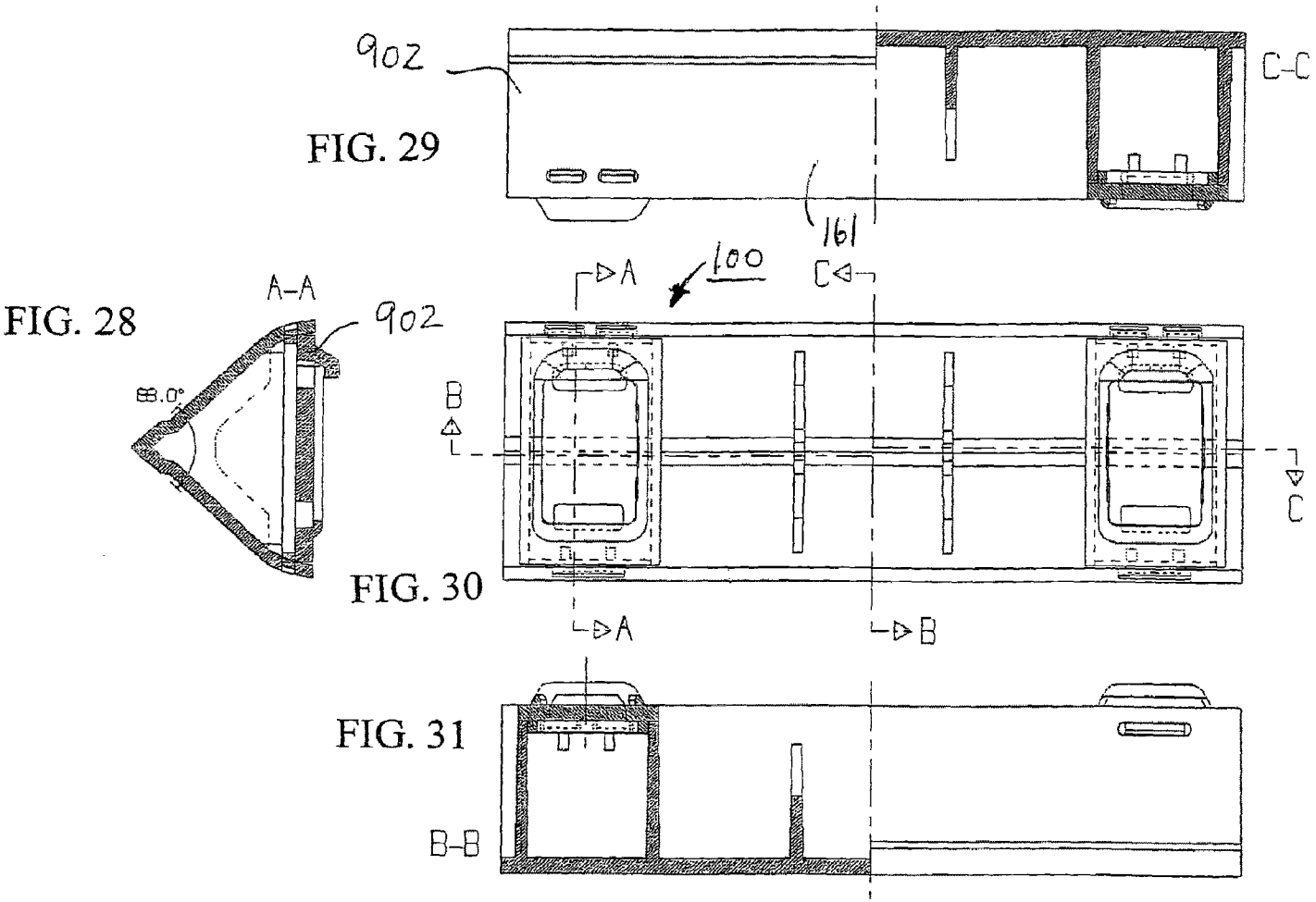
FIG. 28 is a schematic cross sectional view of the universal platform attached to corner sanding base.
FIG. 29 is a schematic sectional view along C-C of FIG. 30.
FIG. 30 is a top schematic plan view of universal platform.
FIG. 31 is a schematic sectional view along B-B of FIG. 30.

Frames 104 can also be connected together with connecting portion 303 which together forms a universal attachment body 906 which in this example is a pole sanding body 402 as shown in FIG. 13. In this example as in the last two bases 150 are connected with a universal platform 902 which in this case is simply platform 159, wherein platform together with bases 150 forms a sanding pad 169. Optionally sanding pad 169 includes sand paper clamps 305. A person skilled in the art will recognize this as a pole sander 400, wherein sand paper is spanned across the bottom of sanding pad 169 and clamped by clamps 305 in position. FIG. 13 is a schematic side elevational view of a typical pole sander 400 also showing a pole attachment 404 for receiving a threaded broom handle therein, together with pole sanding body 402 having two quick release mechanisms 100, wherein pole sanding body 402 is detachably mounted onto sanding pad 169 with two quick release mechanisms 100. Pole sanding body 402 can be quickly and easily attached or detached from sanding pad 169 using the quick release mechanisms 100 as shown in FIGS. 13 through 17.

FIGS. 18 through 22 show details of the latch 180 as described herein.

Figure 32:
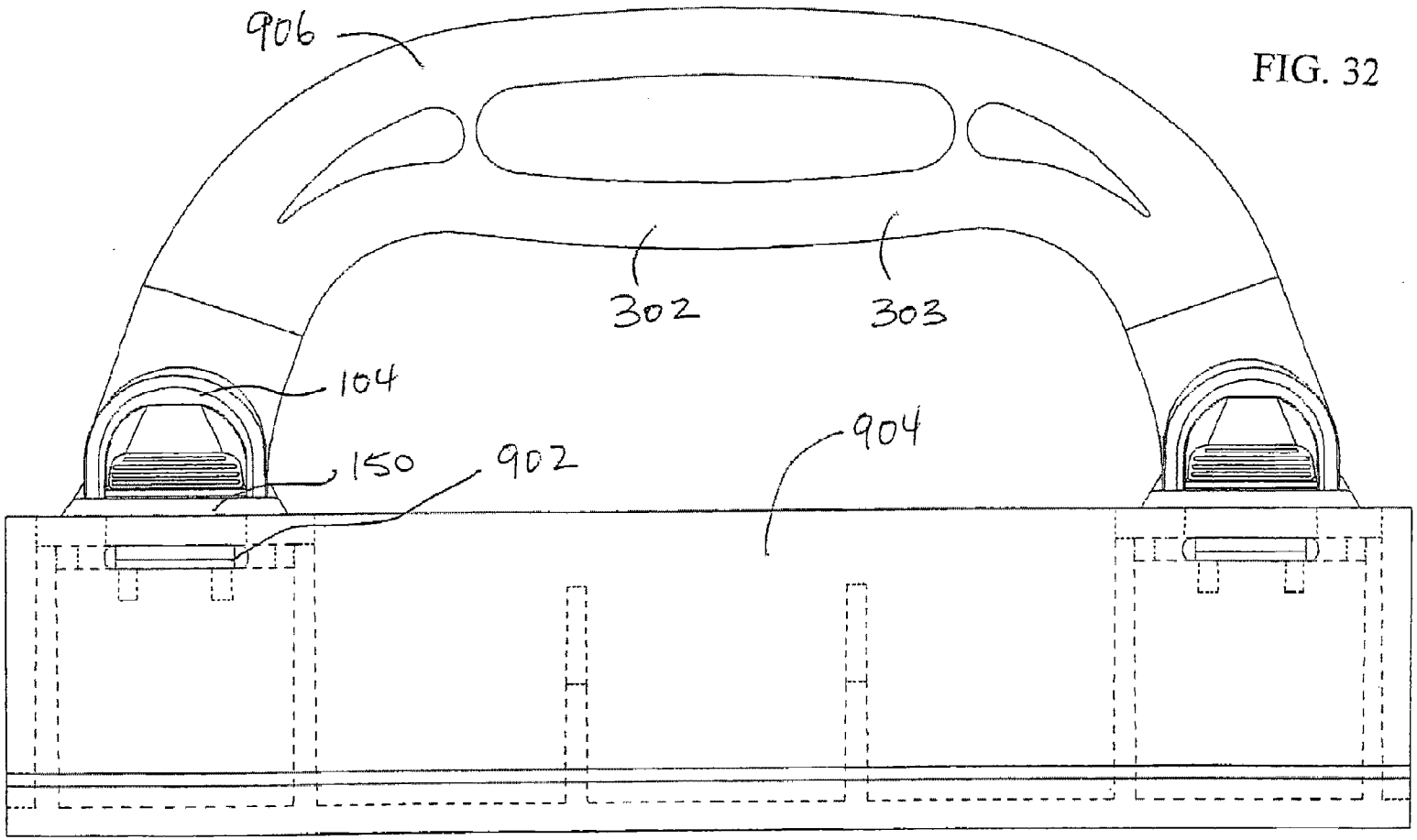
FIG. 32 a side elevational view of the corner sander together with a universal attachment body namely a handle.
Figure 33:
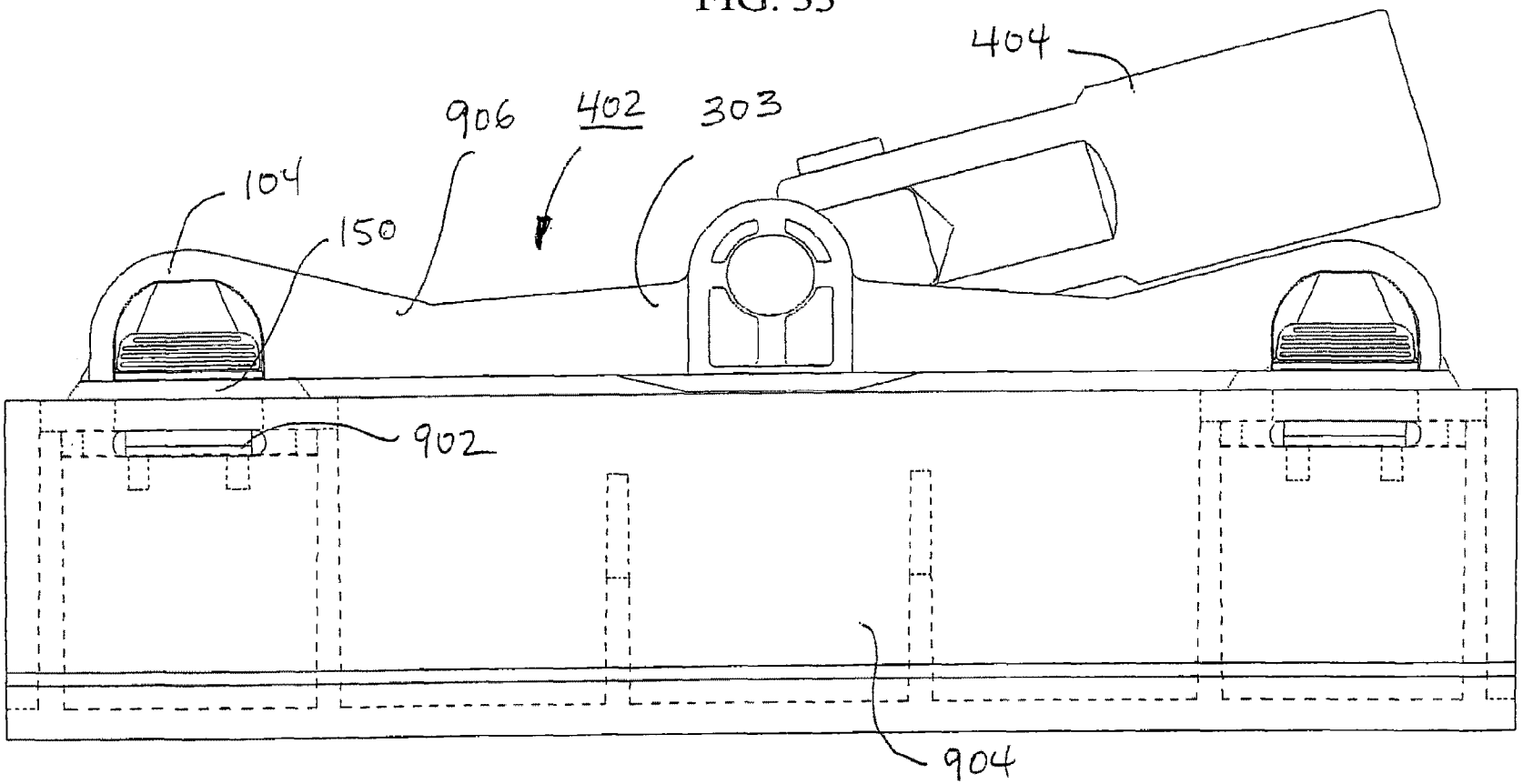
FIG. 33 a side elevational view of the corner sander together with a universal attachment body namely a pole sanding body.

FIGS. 23 to 33 show corner sander 930 including frames 104 connected together with connecting portion 303 thereby forming a universal attachment body 906 which as shown in FIG. 32 is handle 302 or as shown in FIG. 33 is pole sanding body 402. Bases 150 are connected together with platform 161 thereby forming universal platform 902 which in turn attaches to corner sanding base 904 which in turn is connected to sand paper 905. In this example universal platform 902 can in turn be attached to a number of different elements one example given here being a corner sanding base 904.

In Use

Quick release mechanism 100 can be applied to hand tools having a geometry where it is desirable to attach two elements together generally for example a universal attachment body 906 to a universal platform 902 wherein the frame 104 is connected to or integrally part of the universal attachment body 906 and a base 150 is connected to or integrally part of universal platform 902. In this description we show specific examples of how quick release mechanisms 100 can be applied. In one example quick release mechanisms 100 are used to attach for example a manual handle shown as handle 302 and/or a pole sanding body shown as 402 to a platform 159. These examples are both in the field of sanding, however, there is no reason why base 150 could not perform some other function such as a float or other tool which requires the quick release mechanism for attachment of handles and/or other elements. It is not intended that the present invention be limited to sanding tools and equipment, but rather the quick release mechanism 100 can be adapted to a multitude of different hand tools wherein it is desirable to have a mechanism for quickly attaching and detaching a universal attachment body 906 to a universal platform 902.

By way of example only, for providing examples of how the quick release mechanism 100 can be applied to various applications, we are showing quick release mechanism 100 deployed in the field of sanding.

Quick release mechanism as indicated above includes a base 150, latch 180 and a frame 104. The purpose of quick release mechanism 100 is to quickly and easily attach and detach frame 104 to base 150. Frame 104 and base 150 can be part of many different configurations, examples of which are shown in this application.

Figure 3:
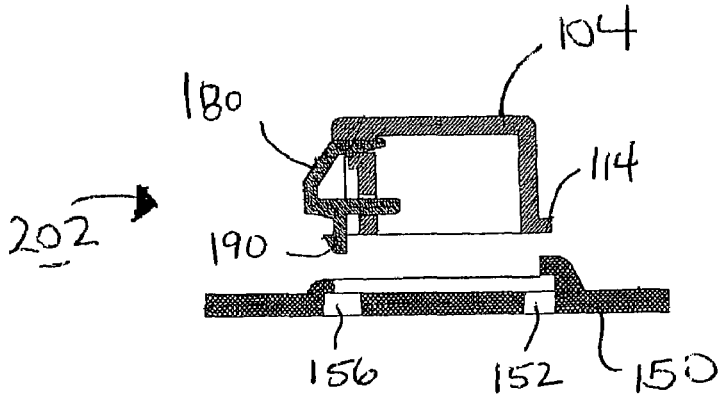
FIG. 3 is a schematic cross sectional view of the quick release mechanism in the detached position.

Frame 104 will normally include a first member 106 spaced from a second member 108 which as shown in FIGS. 1 and 2 are vertical, however it is not necessary that the first member 106 and second member 108 be vertical. First member 106 of frame 104 includes an integrally connected a lip 114 which fits into slot 152 defined in base 150. Slot flange 160 together with base 150 defines slot 152 for cooperatively and slidably receiving lip 114 within slot 152. Second member 108 has defined therein a hinge slot 118 and a guide aperture 116 for receiving hinge member 184 within hinge slot 118 and guide member 188 within guide aperture 116. Latch 180 is slidably received into second member 108 as depicted in FIG. 1, wherein locking tab 186 defined on one distal end of hinge member 184, positively locks latch 180 into frame 104. Latch 180 also includes a push pad 182 which when finger pressure is applied to push pad 182, the entire latch 180 pivots about hinge axis 130 as shown in FIG. 1. In this manner catch 190 can be moved laterally along lateral direction 132 by applying finger pressure to push pad 182. Catch 190 is normally in the locked position as shown in FIG. 2, however it can be urged laterally along lateral direction 132, thereby allowing it to pass past the catch flange and pass through catch aperture 156 defined in base 150 for detaching frame 104 from base 150. Catch 190 latches onto catch flange 158 defined in base 150, when in the attached position 210. As finger pressure is applied to push pad 182, guide member 180 slightly moves laterally within guide aperture 116 and latch 180 pivots or flexes about hinge axis 130. The sequence for attaching frame 104 from the detached position 202 to the attached position 210 is shown in FIGS. 3 through 7. FIG. 3 shows the frame 104 and base 150 in the detached position 202.

Figure 4:
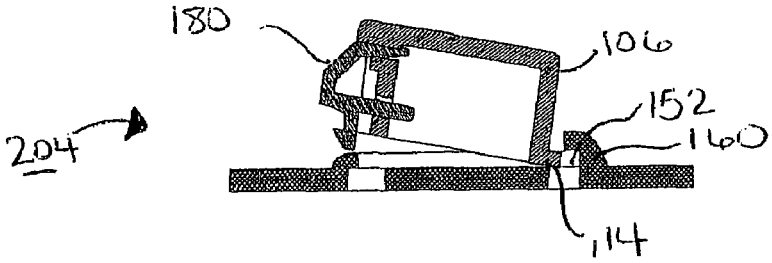
FIG. 4 is a schematic cross sectional view of the quick release mechanism in the first attachment step.
Figure 5:
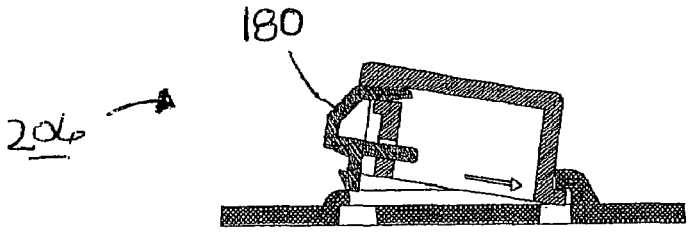
FIG. 5 is a schematic cross sectional view of the quick release mechanism in the second attachment step.

Referring now to FIG. 4, firstly lip 114 is slidably received within slot 152 until first member 106 abuts onto slot flange 160 as shown in FIG. 5. FIG. 4 is the first attachment step 204, whereas FIG. 5 is the second attachment step 206.

Figure 6:
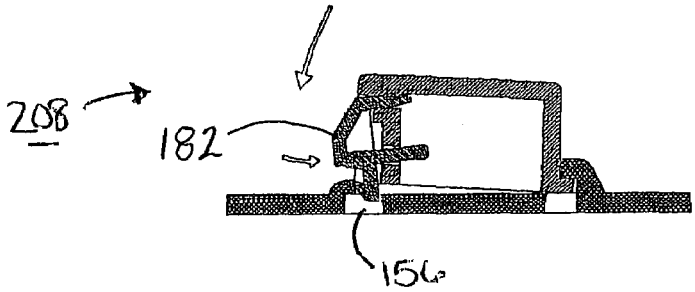
FIG. 6 is a schematic cross sectional view of the quick release mechanism in the third attachment step.
Figure 7:
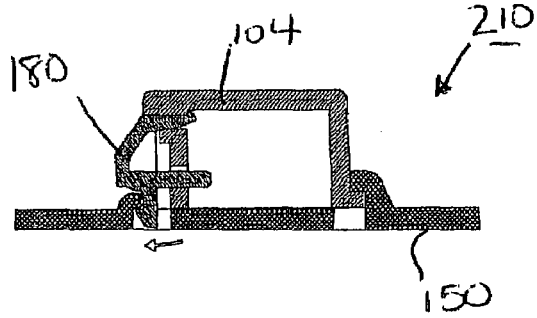
FIG. 7 is a schematic cross sectional view of the quick release mechanism in the attached position.

Referring now to FIG. 6 which is the third attachment step. Finger pressure maybe applied to push pad 182, wherein catch 190 is moved laterally such that it is able to freely pass through catch aperture 156 defined by catch flange 158 and base 150. Catch 190 will automatically be moved laterally into catch aperture 156, when frame 104 is urged downwardly onto base 150. Therefore it is optional to apply finger pressure to push pad 182 when attaching frame 104 to base 105. By applying finger pressure to push pad 182, the entire latch mechanism 180 pivots about hinge axis 130, thereby allowing catch 190 to clear through catch aperture 156. Once the catch 190 is clear through catch aperture 156, pressure can be released from push pad 182 and natural resiliency of latch 180, places catch 190 in the normally closed or attached position 210 as shown in FIG. 7, wherein catch makes positive contact with catch flange 158, thereby preventing frame 104 from being accidentally detached from base 150. During the attachment process, frame 104 is urged downwardly onto base 150. Inclined surface 191 will contact catch flange 158 and move catch 190 laterally under the downward pressure placed on frame 104.

In order to detach frame 104 from base 150, the reverse of the procedure just described above is applied, namely FIG. 7 through 3 in reverse order is initiated in order to detach frame 104 from base 150. One must apply finger pressure to push pad 182 in order to detach frame 104 from base 150.

FIGS. 8 through 12 show a hand sander 300 with two quick release mechanisms 100 deployed therein. In this example, frame 104 is integrally part of handle 302 as shown in drawing FIGS. 8 through 12.

A second example of how quick release mechanism 100 can be deployed in a pole sander is shown in FIGS. 13 through 17. Pole sander 400 includes a pole attachment 404 and a pole sanding body 402. Frame 104 is integrally part of pole sanding body 402 as shown in FIG. 13 through 17. A person skilled in the art will note that a piece of flat sand paper (not shown) can be stretched across the bottom of sanding pad 169 and clamped in by clamps 305. Using the steps described above for attachment and detachment of frame 104 from base 150, one can easily attach pole sanding body 402 onto sanding pad 169. Pole sanding body 402 together with attached sanding pad 169 defining a pole sanding frame 920. Pole sanding frame 920 together with a pole attachment 404 defining a pole sander 400.

A person skilled in the art will recognize that the same base 150 can be used for pole sander 400 and also for the hand sander 300. In this case handle 302 can be quickly attached or detached from sanding pad 169 and pole sanding body 402 together with a pole attachment 404 can be quickly attached to the same sanding pad 169 and/or detached from that same sanding pad 169 quickly and easily. Therefore the same sanding pad 169 can be used as either a hand sander 300 and/or a pole sander 400 as depicted.

The details of the latch 180 are shown in FIGS. 18 through 22, wherein one example of how latch 180 could be designed is shown. Kindly note that the geometry, of for example the guide member and/or the hinge member and/or the push pad and/or for that matter the catch can be altered somewhat and yet produce the same effect. For example the guide member 188 may be rod like and/or be flat. Similarly the hinge member 184 may also take on various shapes provided that the same function is maintained.

It should be apparent to persons skilled in the arts that various modifications and adaptation of this structure described above are possible without departure from the spirit of the invention the scope of which defined in the appended claim.

I claim:

1. A hand tool quick release mechanism for releaseably connecting a frame to a base, the quick release mechanism comprising; a frame connecting means and a base connecting means each for respectively coupling releasably the frame and base together, wherein the frame and base are placed into an attached position by urging the frame connecting means into the base connecting means; and wherein a) the frame connecting means includes a latch, wherein the latch includes a push pad which is connected to a hinge member, the hinge member includes a locking tab at one end, wherein the latch engages with the base connecting means coupling together the base and frame in the attached position, b) wherein the hinge member is received within a cooperatively dimensioned hinge slot defined in the frame such that the locking tab engages with a portion of the frame thereby firmly locking the hinge member to the frame;

c) wherein the hinge member adapted to resiliently bias the latch against the base connecting means whereby applying finger pressure to the push pad operably disconnects the base from the frame such that the base and frame are in a detached position.

2. The quick release mechanism claimed in claim 1 wherein the latch further includes a catch attached to the push pad and the base connecting means includes a catch flange such that the catch and catch flange cooperatively and releasably couple together when the base and frame are in an attached position.

3. The quick release mechanism claimed in claim 2 wherein the frame connecting means includes a lip and the base connecting means includes a slot flange adapted to receive the lip slideably therein, such that the lip and slot flange cooperatively and releasably couple together when the base and frame are in the attached position.

4. The quick release mechanism claimed in claim 3, wherein the lip is operably spaced from the catch and the slot flange is operably spaced from the catch flange such that to place the frame and base into the attached position the lip is slideably urged into a slot defined in the base and thereafter the catch is urged past the catch flange into a catch aperture defined in the base thereby coupling the catch with the catch flange.

5. The quick release mechanism claimed in claim 2 wherein the latch further includes a guide member connected to the push pad for guiding the catch movement in a lateral direction when the catch is moved by applying finger pressure to the push pad.

6. The quick release mechanism claimed in claim 5 wherein the guide member and hinge member being substantially parallel and spaced apart by the push pad and extending horizontally away from the push pad.

7. The quick release mechanism claimed in claim 2 wherein the hinge member resiliently bending about a hinge axis and thereby resiliently biasing the catch against the catch flange.

8. The quick release mechanism claimed in claim 2 wherein the catch includes an inclined surface for slidably contacting the catch flange when the catch being urged past the catch flange.

9. The quick release mechanism claimed in claim 5 wherein the frame further includes a guide aperture for slideably receiving the guide member therein thereby guiding the catch movement in a lateral direction when the catch is moved past the catch flange.

10. A hand tool with two spaced apart quick release mechanisms as claimed in claim 1, 4, or 9, wherein the frame connecting means of each quick release mechanism are rigidly connecting together with a connecting portion, such that the two frame connecting means together with the connecting portion form a universal attachment body, and wherein the base connecting means of each quick release mechanism are attached to a platform, wherein the two base connecting means together with the platform form a universal platform, wherein the universal attachment body and the universal platform are releaseably connectable between an attached position and a detached position.

11. A hand sander with a detachable quick release handle; the hand sander includes two spaced apart quick release mechanisms as claimed in claim 1, 4, or 9, wherein the frame connecting means of each quick release mechanism are rigidly connected together with a connecting portion, such that the two frame connecting means together with the connecting portion form a unitary handle, and wherein the base connecting means of each quick release mechanism are attached to a platform, wherein the two base connecting means together with the platform form a unitary sanding pad, wherein the handle and the sanding pad are releaseably connectable between an attached position and detached position, wherein in the attached position the handle together with the sanding pad is a hand sander.

12. A pole sanding frame with a detachable quick release pole sanding body, the pole sanding frame comprising two spaced apart quick release mechanisms as claimed in claim 1, 4, or 9, wherein the frame connecting means of each quick release mechanism are rigidly connected together with a connecting portion such that the two frame connecting means together with the connecting portion form a unitary pole sanding body, and wherein the base connecting means of each quick release mechanism are attached to a platform wherein the two base connecting means together with the platform form a unitary sanding pad, wherein the pole sanding body and the sanding pad are releaseably connectable between an attached position and detached position, wherein in the attached position the pole sanding body together with the sanding pad is a pole sanding frame.

* * * * *